US005441355A

United States Patent [19]

Moore

[11] Patent Number: 5,441,355

[45] Date of Patent: Aug. 15, 1995

[54] SCRUBBER DEVICE WITH WATERPROOF MITT

[75] Inventor: Barrett H. Moore, Chicago, Ill.

[73] Assignee: Arbitrage Imports Incorporated, Chicago, Ill.

[21] Appl. No.: 248,399

[22] Filed: May 24, 1994

[51] Int. Cl.[6] ..... A47K 7/02; A47L 13/18; A46B 5/04

[52] U.S. Cl. ..... 401/7; 15/227

[58] Field of Search ..... 15/227; 401/7, 8, 200, 401/201

[56] References Cited

U.S. PATENT DOCUMENTS

| | | | |
|---|---|---|---|
| D. 268,968 | 5/1983 | Sami . | |
| 744,455 | 11/1903 | Alwart | 15/227 |
| 836,181 | 11/1906 | Cray | 15/227 |
| 1,161,719 | 11/1915 | Norton | 401/7 |
| 1,979,130 | 10/1934 | Wiley . | |
| 2,061,219 | 11/1936 | Wright | 15/227 |
| 2,269,721 | 1/1942 | Johnson | 401/7 |
| 2,663,890 | 12/1953 | Sullins | 401/7 |
| 2,722,706 | 11/1955 | Chopp . | |
| 2,831,206 | 4/1958 | Curtis | 15/227 |
| 3,411,982 | 11/1968 | Kavalir et al. . | |
| 3,701,604 | 10/1972 | Holroyd | 401/7 |
| 3,740,262 | 6/1973 | Agostinelli . | |
| 3,856,561 | 12/1974 | Esemplare et al. . | |
| 3,883,897 | 5/1975 | Lefkowitz | 401/7 |
| 3,922,221 | 11/1976 | Homsy et al. . | |
| 3,967,014 | 6/1976 | Esemplare et al. . | |
| 4,027,060 | 5/1977 | Esemplare et al. . | |
| 4,082,862 | 4/1978 | Esemplare et al. . | |
| 4,218,779 | 8/1980 | Hart et al. . | |
| 4,304,008 | 12/1981 | Joung . | |
| 4,319,852 | 3/1982 | Bell | 401/200 |
| 4,349,288 | 9/1982 | Bond | 401/7 |
| 4,371,987 | 2/1983 | Brasfield . | |
| 4,589,146 | 5/1986 | Taylor . | |
| 4,593,427 | 6/1986 | Ortolivo . | |
| 4,597,108 | 7/1986 | Momose . | |
| 4,620,528 | 11/1986 | Arraval | 401/7 |
| 4,621,388 | 11/1986 | Ortolivo . | |
| 4,953,998 | 9/1990 | McCartherens | 401/7 |
| 5,127,976 | 7/1992 | McLeish et al. . | |
| 5,169,251 | 12/1992 | Davis | 401/7 |
| 5,248,211 | 9/1993 | Holst | 401/7 |

FOREIGN PATENT DOCUMENTS

| | | | |
|---|---|---|---|
| 1135018 | 4/1957 | France | 401/7 |
| 2727280A1 | 12/1978 | Germany . | |
| 6704835 | 11/1967 | Netherlands . | |
| 2113977 | 8/1983 | United Kingdom . | |
| 2143720 | 2/1985 | United Kingdom . | |

OTHER PUBLICATIONS

"LDS-50 Automatic Dipping System," two-page brochure, ACC Automation Company, Akron, Ohio (1989).

*Primary Examiner*—David A. Scherbel
*Assistant Examiner*—Randall E. Chin
*Attorney, Agent, or Firm*—Fitch, Even, Tabin & Flannery

[57] ABSTRACT

A mitt of latex material includes a pad of cleaning media covering the palm and inner finger area of a user's hand, and at least one strip of cleaning media covering the back of the user's hand extending across at least some of the user's fingers.

2 Claims, 7 Drawing Sheets

SCRUBBER DEVICE WITH WATERPROOF MITT

BACKGROUND OF THE INVENTION

1. Field of the Invention

The present invention pertains to waterproof cleaning devices to be worn on the hand, and in particular to mitts and mitt-like devices carrying a cleaning media.

2. Description of the Related Art

Hand coverings, particularly gloves of rubber and plastics materials, are in widespread use today in a wide variety of tasks. For example, surgical gloves are used to reduce the risk of infection during surgery and other procedures performed on living bodies. It is important in such applications that manual dexterity of the user not be impeded, and as a result, gloves of this type are of relatively thin construction. Gloves have also been proposed to protect a user's hand from contact with chemicals such as acids and caustic solutions, for example. Gloves of this type are frequently used when carrying out work assignments and, accordingly, must be of fairly rugged construction, in contrast to surgical gloves. It is important in such applications that the gloves restrict the user's manual dexterity as little as possible, although it is generally accepted that the range of motion will not be comparable with that possible with more delicate surgical gloves.

Gloves have also been proposed for more specialized uses. For example, U.S. Pat. No. 2,722,706 discloses a sponge-tipped rubber glove to aid beauticians in applying chemical treatments. Sponge pads are carried on the fingertips of the gloves to hold the chemical being applied. British application GB 2 113 977 discloses a glove of resilient or fabric material which has the fingertips and palm of the glove covered with a sponge coating. The sponge material may additionally be made abrasive. Alternative embodiments, in the form of a mitten, for example, are disclosed. U.S. Pat. No. Des. 268,968 shows a scrubbing glove. British Patent application 2 143 720 discloses a glove of rubber or plastics composition having abrasive portions in the palm of the glove. The abrasive portions can include webs or pads of abrasive material. The British patent also shows a mitten having an abrasive palm surface, with the back smooth and relatively featureless.

U.S. Pat. Nos. 4,593,427 and 4,621,388 show a glove with cleaning or abrading surfaces on the palm, and ovoid abrading units on the back of the glove, in the knuckle region of the wearer's hand.

U.S. Pat. No. 5,127,976, assigned to the assignee of the present invention, discloses a glove or mitten of latex rubber to which a pad comprising a web-like matrix of plastic fibers is secured.

SUMMARY OF THE INVENTION

It is an object of the present invention to provide a mitt carrying a pad of cleaning media on the palm, and one or more pads of abrasive media on the back of the hand, adjacent the wearer's knuckles.

Another object according to the present invention is to provide a mitt of the above-described type having a latex rubber composition.

These and other objects according to principles of the present invention, which will become apparent from studying the appended description and drawings, are provided in a covering for the hand for protecting the hand while providing a cleaning device, comprising:

a mitt of latex material defining an interior cavity for receiving a user's hand and wrist;

a pad of cleaning media covering the palm and inner finger area of a user's hand; and, optionally, at least one pad of cleaning media covering the back of the user's hand, extending across at least some of the user's fingers.

DETAILED DESCRIPTION OF THE PREFERRED EMBODIMENTS

Figure 3:
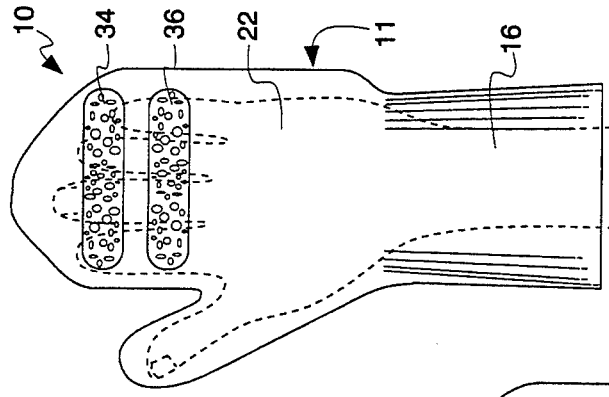
FIG. 3 is a top plan view thereof.
Figure 2:
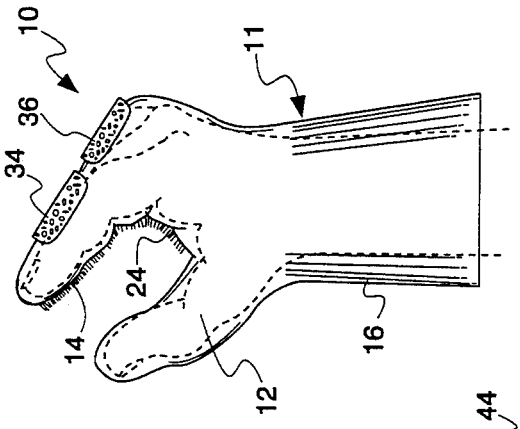
FIG. 2 is a side view thereof.
Figure 1:
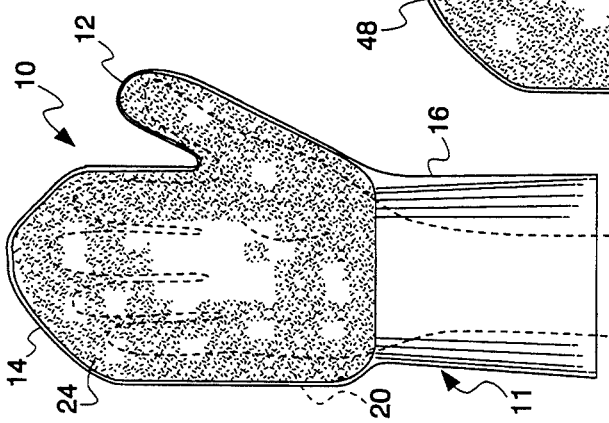
FIG. 1 is a bottom plan view of a mitt illustrating principles of the present invention.

Referring now to the drawings, and initially to FIGS. 1–3, a first embodiment of a scrubber mitt illustrating principles of the present invention is generally indicated at 10. At the outset, it is noted that the term "mitt" or "mitten" is used herein to denote a covering for the hand including at least one portion for receiving two or more digits, whether fingers or thumb. The term "finger portion" herein refers to a portion of a mitt for receiving one or more fingers or a thumb.

The mitt 10 includes a body 11 defining a cavity for receiving the user's hand and wrist, including a first finger portion 12 for receiving a user's thumb, a second finger portion 14 for receiving the user's fingers, and a cuff 16 for covering the user's wrist and forearm. The mitt 10 has opposed front and back surface parts 20, 22. The front part 20 covers a user's palm, and a front or inner surface of the user's fingers and thumbs. In FIG. 1, the front part of the mitt 10 is covered with a pad 24 of cleaning media of virtually any composition available today which is useful for cleaning purposes. For example, the pad 24 can be made of natural or artificial sponge material, a web of woven natural or manmade fibers, such as burlap or other coarse, absorbent material. Alternatively, pad 24 can be made of any number of conventional abrasive cleaning pads, such as those available from Minnesota Mining and Manufacturing of Minneapolis, Minn., commonly available under the trademark SCOTCHBRITE. In some industrial applications, pad 24 can be made of a grit coated backing layer, commonly known as "sandpaper." Pad 24 could also have a bristle composition so as to form or resemble a brush.

The mitt 10 is preferably made of a flexible waterproof material, such as rubber or plastic material to which pad 24 is affixed by suitable adhesive joinder. Most preferably, mitt 10 is made of latex rubber which is treated in an aqueous halogen solution after forming. The mitt body is preferably formed of one piece, as described in commonly assigned U.S. Pat. No. 5,127,976, the disclosure of which is incorporated as if fully set forth herein.

Figure 25:
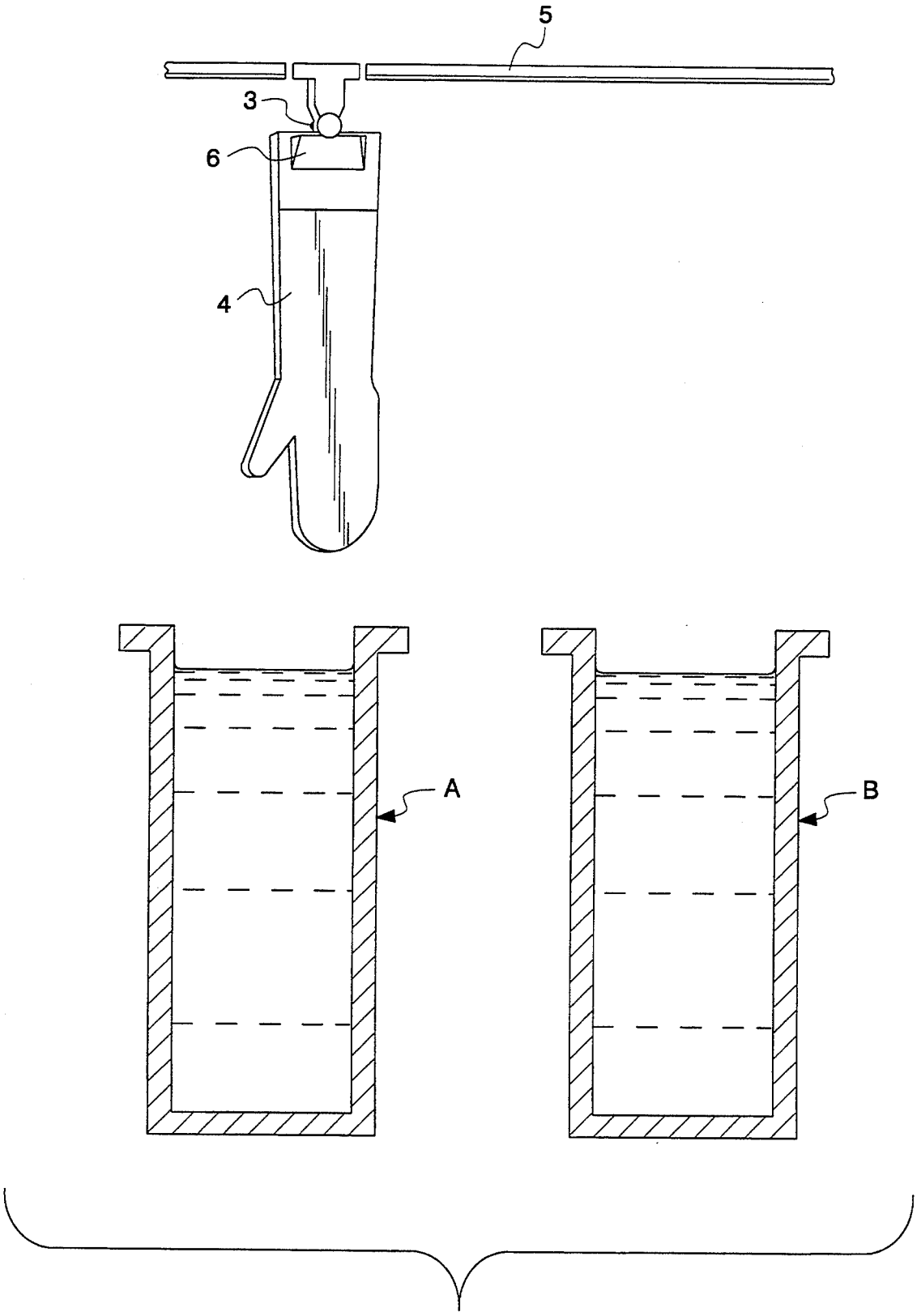
FIG. 25 is a schematic representation of method steps for forming the mitts shown above.

Referring now to FIG. 25, a flat former 4 is cut to the required shape from a sheet of aluminum or other suitable material. The former is prepared for dipping in a vat of latex rubber. For example, in the preferred embodiment, former 4 is made from aluminum, and in preparation for dipping is treated with a solution of hydrochloric acid. A conventional platen assembly moves in reciprocating fashion, back and forth along a rail 5 to allow the former 4 to be positioned above vats A or B. The former 4 is held on the platen assembly by clamp 6. Vat A holds an aqueous colloid of latex rubber and the vat is of sufficient depth to receive former 4. The former is lowered into vat A, and after a suitable residence time in the vat, latex rubber adheres on the surface of former 4 to a desired thickness, typically on the order of 1 millimeter. The former 4 is then raised out of the vat and dried. Upon drying and hardening, the latex rubber takes on the form of the mitt body 11, and when removed from former 4, thereby becomes a separate, rubber article of manufacture. The formed mitt is then placed into Vat B which contains a halogen solution, preferably an aqueous halogen solution and most preferably a 5% aqueous bromine solution. The mitt articles are allowed to soak in Vat B for a prescribed period, typically on the order of several minutes, to perform a leaching operation in which antioxidants are removed from the surface layer of the latex rubber article so as to toughen the outer surface of the mitt body 11 without affecting its flexibility.

Figure 26:
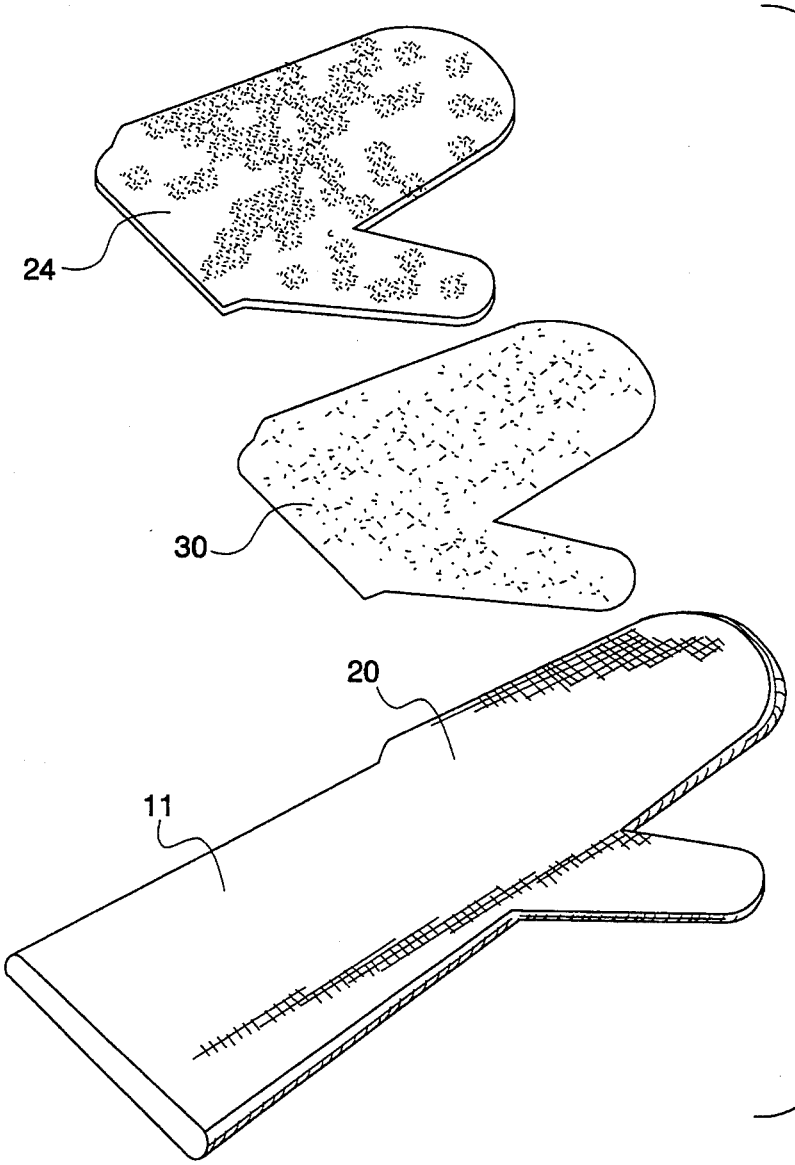
FIG. 26 shows further steps in the construction of the mitt.

Referring to FIG. 26, a template (not shown) is placed over the front part of mitt body 11 so as to expose the palm portion and inner surfaces covering the fingers and thumb portions. A suitable adhesive such as urethane resin 9521 (ICI) cross-linked with 3.5% Delta Bond AR (ICI) is applied to the underside of pad 24 so as to form a film or layer schematically indicated as 30 in FIG. 26. Pad 24 is then pressed against mitt body 11 and allowed to cure, thereby forming a permanent bond between the pad and mitt body. If desired, media 24 can be impregnated with suitable cleaning agents, such as soaps, waxes or other coatings.

Turning now to FIGS. 2 and 3, strips 34, 36 (made of suitable cleaning media, preferably the same as that described above for pad 24) are applied to the back part 22 of mitt body 11 so as to cover adjoining portions of a user's fingers. As indicated in FIG. 2, the strips 34 are located between the first and second joints of the user's fingers (as referenced from the user's fingertips). Strips 36 are located between second and third joints of the user's fingers, the third joint being located at the user's knuckles. As mentioned, the strips 34, 36 can be formed from a wide variety of suitable cleaning materials. For example, it is preferred that the strips 34, 36 be made of abrasive media suitable for scrubbing. It has been found that substantial pressures can be generated by a user on strips 34, 36 with a minimal physical exertion. Further, abrasive strips 34, 36 provide an attractive complement to a pad 24 of cleaning media which can be the same or alternatively different from the media employed in strips 34, 36. As a further alternative, the media employed for strip 34 can differ from the media employed for strip 36. For example, strip 36 can be made of a grit-coated, abrasive material, strip 34 can be made of a less abrasive material, while pad 24 could be made of a lesser abrasive material or a cleaning sponge.

The strips 34, 36 are applied to the back part 22 of mitt body 11, in the same manner described above as that for the joinder of pad 24 to the front part 20 of mitt body 11. If desired, virtually any commercially available bonding technique can be used to join strips 34, 36 to mitt body 11. If desired, either strip 34 or 36 could be eliminated. Because of the location of strips 34, 36, when the user forms a fist for cleaning a surface, strips 34 and 36 can be made to have dissimilar thicknesses, if desired. For example, it may be desirable in some circumstances to provide a resilient backing or a grit-coated abrasive material for one of the strips, while the other strip can have a different composition.

Figure 4:
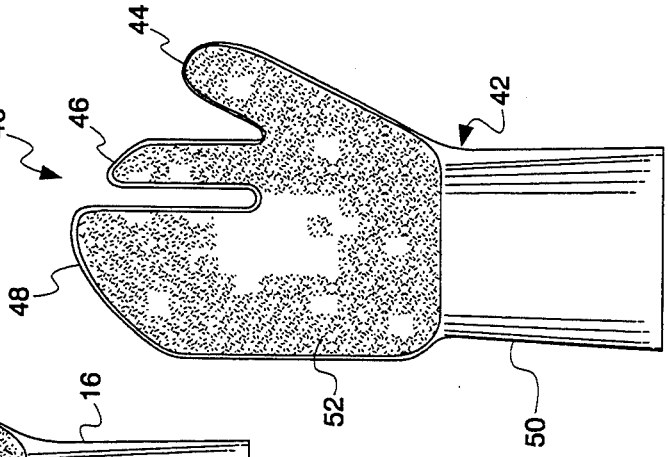
FIG. 4 is a bottom plan view of an alternative embodiment of a mitt according to principles of the present invention.
Figure 5:
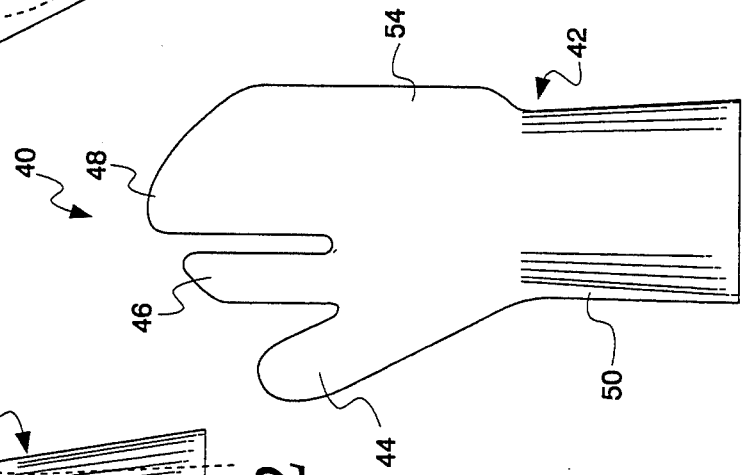
FIG. 5 is a top plan view thereof.
Figure 6:
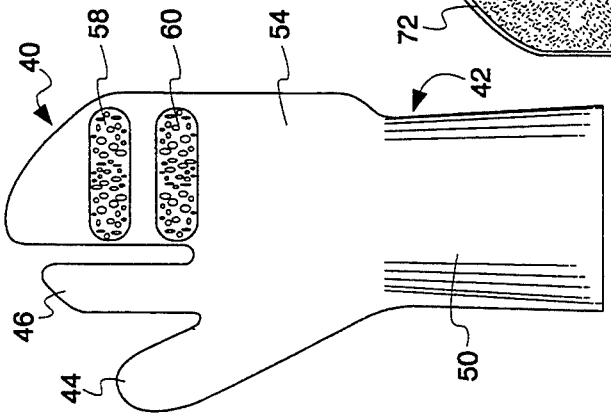
FIG. 6 is a top plan view similar to that of FIG. 5 but showing abrasive strips applied to the back of the mitt.

Turning now to FIGS. 4–6, a mitt is shown with separate portions for the thumb, forefinger, and remaining fingers of a user's hand. More specifically, the mitt shown in FIG. 4, generally designated at 40, includes a body generally indicated at 42 having a thumb portion 44, a first finger portion 46 for the forefinger, a second finger portion 48 for the remaining fingers, and a cuff portion 50. A pad of cleaning media similar to the pad 34 described above, and designated by the number 52, is bonded to the front part of mitt body 42, so as to cover the palm and inner surfaces of the user's fingers and thumb.

FIG. 5 shows a back portion 54 of the mitt 40. FIG. 6 shows an alternative arrangement of mitt 40 in which strips 58, 60 (similar to the strips 34, 36 described above) are bonded to the back part 54 of mitt body 42. If desired, the strips 58, 60 can be extended to the first finger portion 46 adjacent the knuckle of a user's forefinger.

Figure 9:
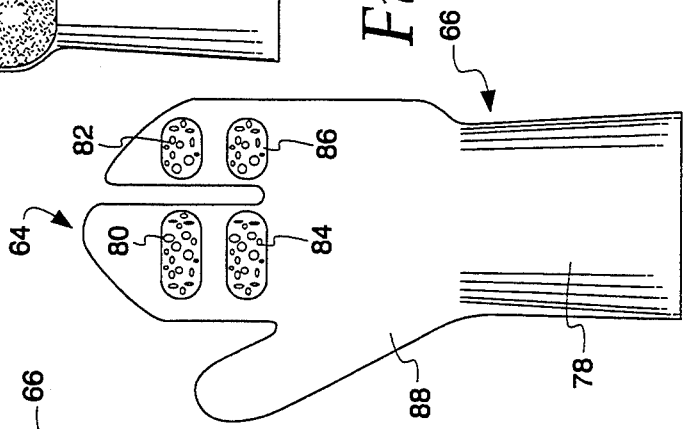
FIG. 9 is a top plan view similar to that of FIG. 8 but showing abrasive strips applied to the back of the mitt.
Figure 8:
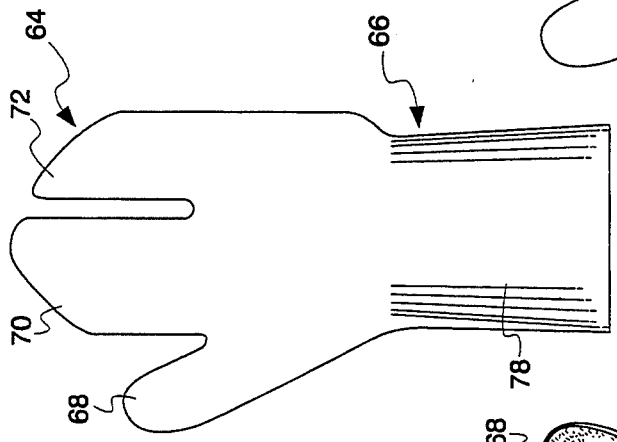
FIG. 8 is a top plan view thereof.
Figure 7:
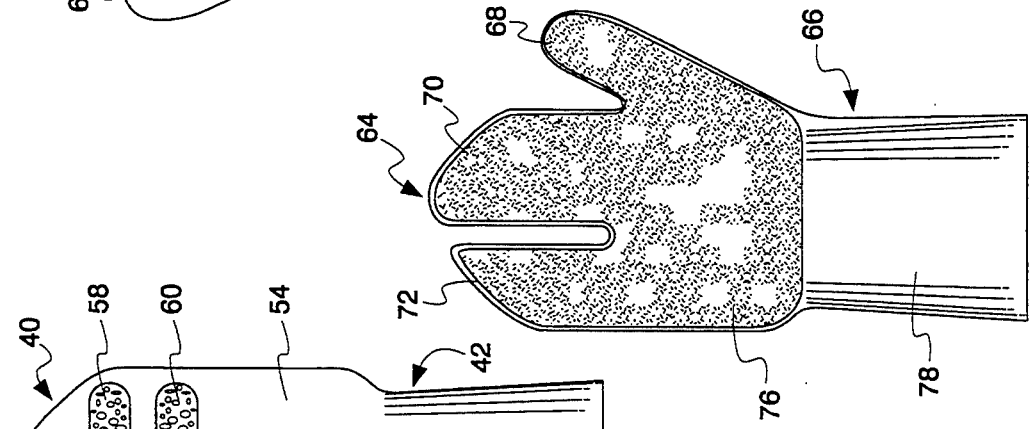
FIG. 7 is a bottom plan view of an alternative embodiment of a mitt according to principles of the present invention.

Turning now to FIG. 7, an alternative embodiment of a mitt according to principles of the present invention is generally indicated at 64. Mitt 64 includes a mitt body generally indicated at 66 and including a thumb portion 68, a first finger portion 70, for the user's forefinger and middle finger, and a second finger portion 72 for the user's ring finger and little finger. The mitt body 66 is, except for the arrangement of a finger portions, substantially identical to the mitt body 11 described above. A pad 76 of cleaning media (substantially similar to the pad 24 described above) is bonded to the front part of the mitt body 66. FIG. 8 shows the mitt 64, including the back or upper parts of thumb portion 68, finger portions 70, 72 and a cuff portion 78. FIG. 9 shows an alternative arrangement of mitt 64 in which strips 80–86 are bonded to the back part 88 of mitt body 66. The strip portions 80, 82 lie between the first and second joints of the user's finger, while the strips 84, 86 lie between the second and third joints of the user's fingers, being generally aligned in the manner described above with respect to FIG. 2. The strips 80–86 are preferably made of similar cleaning media, of the type described above with respect to pad 24. However, the pads 80–86 could be made of different materials, if desired.

Figure 10:
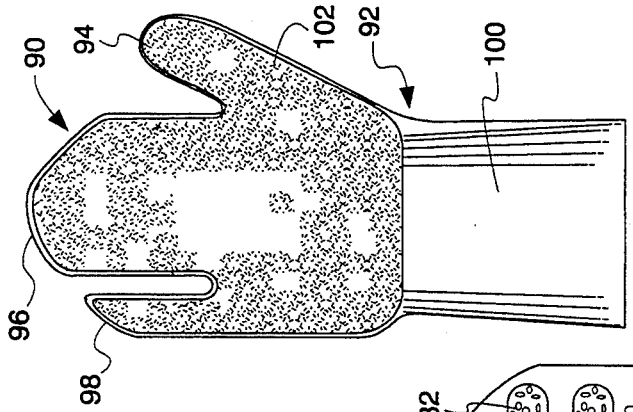
FIG. 10 is a bottom plan view of an alternative embodiment of a mitt according to principles of the present invention.
Figure 12:
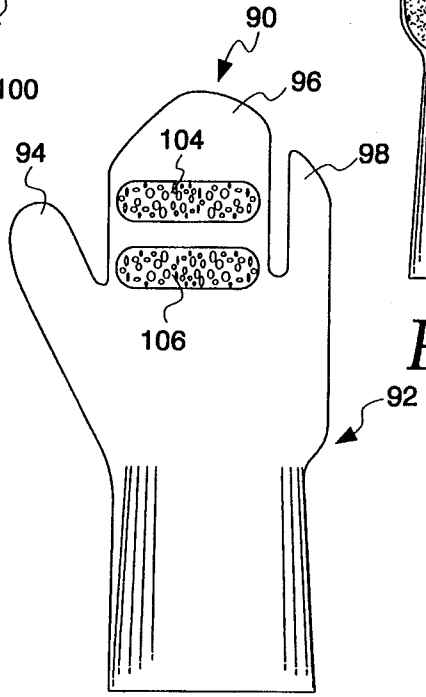
FIG. 12 is a top plan view similar to that of FIG. 11 but showing abrasive strips applied to the back of the mitt.
Figure 11:
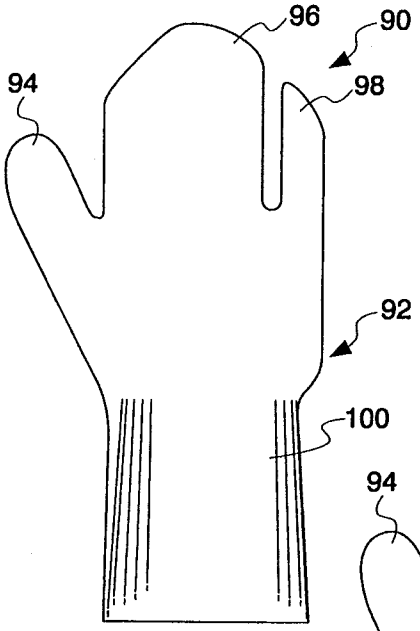
FIG. 11 is a top plan view thereof.

Turning now to FIGS. 10–12, a further embodiment of a mitt according to principles of the present invention is generally indicated at 90. The mitt 90 has a body portion 92 including a thumb portion 94, a first finger portion 96 for three of the user's fingers, and a finger portion 98 for the remaining, little finger of the user's hand, along with a cuff part 100. A pad 102 of material, similar to that of pad 24 described above, is bonded to the front part of mitt body 92.

FIG. 11 shows the back or upper part of mitt 90. FIG. 12 shows an alternative embodiment of mitt 90 in a view similar to that of FIG. 11 but with the addition of strips 104, 106 bonded to the back part of mitt body 92. The strip 104 is positioned between the first and second joints of the user's fingers, similar to the positioning of strip 34 in FIG. 2, while strip 106 is positioned between the second and third joints of the user's fingers, similar to the strip 36 shown in FIG. 2. If desired, either or both of the strips 104, 106 could be extended to the first finger part 98. The strips 104, 106 are preferably of similar material (preferably comprising the materials described above for pad 24) although the strips could be made of different materials, if desired.

Figure 15:
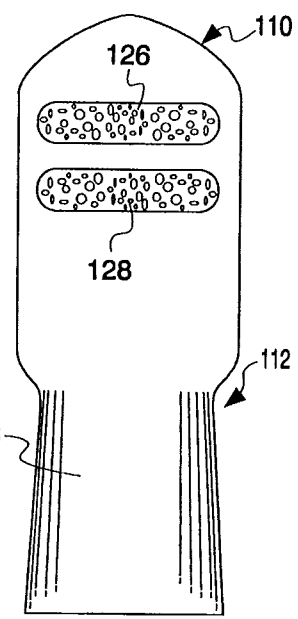
FIG. 15 is a top plan view similar to that of FIG. 14 but showing abrasive strips applied to the back of the mitt.
Figure 14:
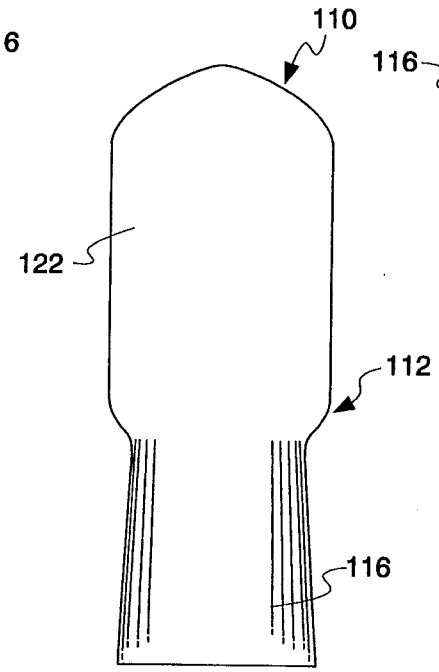
FIG. 14 is a top plan view thereof.
Figure 13:
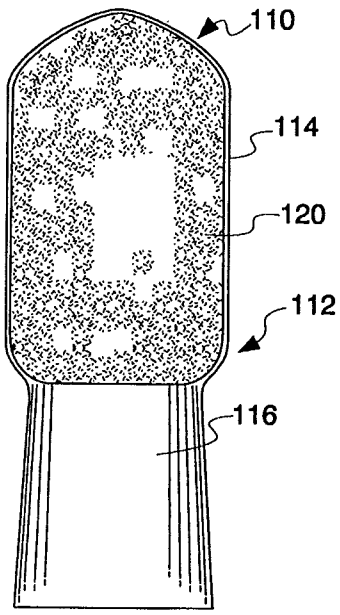
FIG. 13 is a bottom plan view of an alternative embodiment of a mitt according to principles of the present invention.

Turning now to FIGS. 13–15, a further embodiment of a mitt illustrating principles of the present invention is generally indicated at 110. Mitt 110 includes a mitt body 112 having a single finger portion 114 for all of the user's fingers and thumb and a cuff portion 116. A pad 120 is bonded to the front part of mitt body 112 and may be made of any of the types of materials described above for pad 24.

FIG. 14 shows the back or top part of mitt 110. FIG. 15 shows an alternative embodiment of mitt 110 in which strips 126, 128 are bonded to back part 122 of mitt body 112. The strips 126, 128 can be made from any of the materials described above for pad 24 and are preferably of similar material composition. However, if desired, the strips 126, 128 can have different material constructions, if desired.

Figures 16, 17, 18, 19, 20:
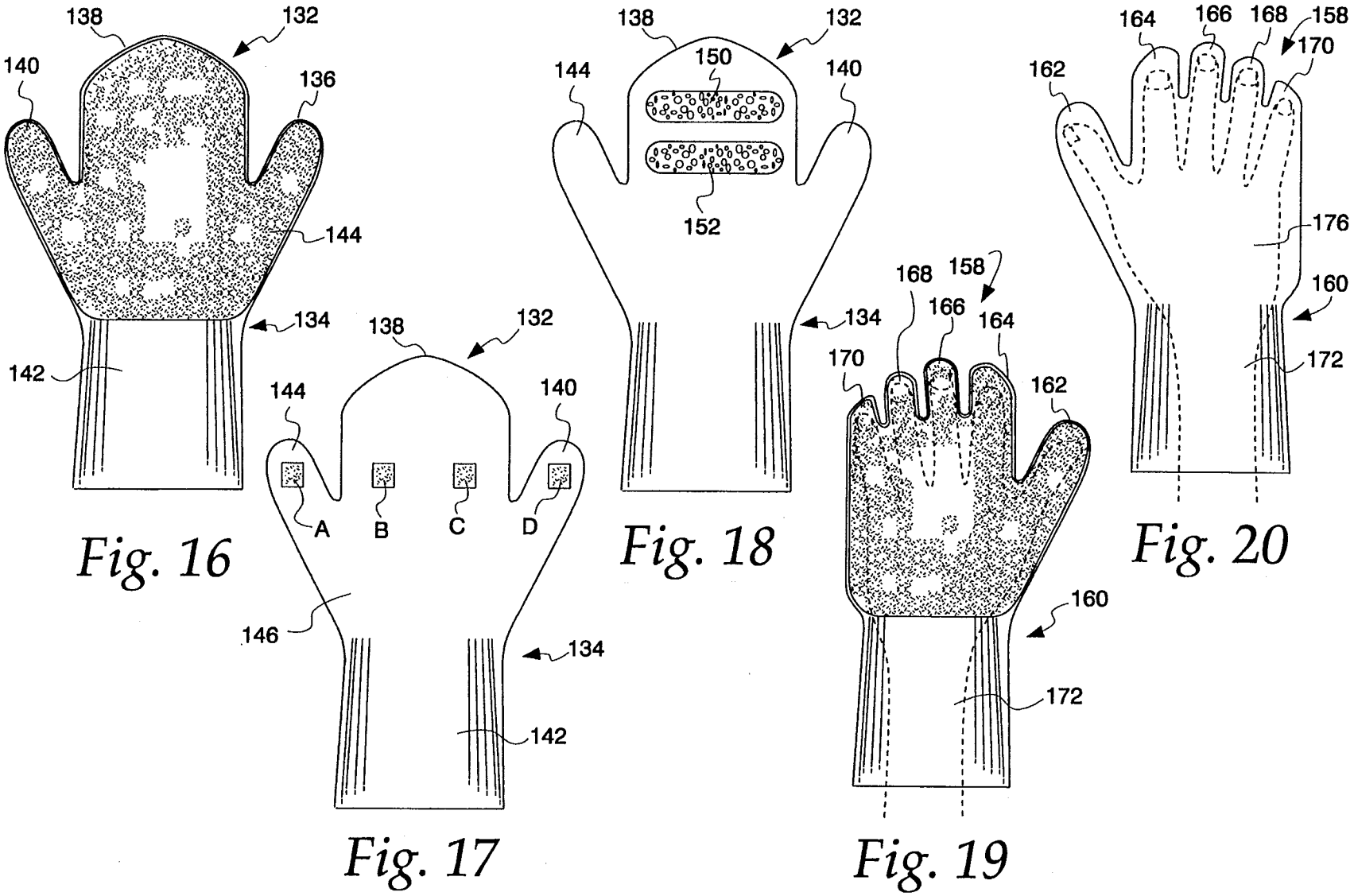
FIG. 16 is a bottom plan view of an alternative embodiment of a mitt according to principles of the present invention.
FIG. 17 is a top plan view thereof.
FIG. 18 is a top plan view similar to that of FIG. 17 but showing abrasive strips applied to the back of the mitt.
FIG. 19 is a bottom plan view of an alternative embodiment of a mitt according to principles of the present invention.
FIG. 20 is a top plan view thereof.

Turning now to FIGS. 16–18, an additional embodiment of a mitt illustrating principles of the present invention is generally indicated at 132. Mitt 132 has a mitt body 134 substantially identical to mitt body 11 described above, except for the arrangement of finger positions. Mitt 132 has a first thumb portion 136 for a right-handed user, a finger portion 138 for all of the user's fingers, a second thumb portion 140 for a left-handed user, and a cuff portion 142. A pad 144 is bonded to the front part of mitt body 134 and can be made of any of the material constructions referred to above for pad 24. FIG. 17 shows the back or top part 146 of mitt 132. If desired, hook and loop fastener material may be provided at points A and B to "tie-back" the thumb portion 144 for left-handed users. Similarly, hook and loop fastener material may be provided at points C and D to "tie-back" thumb portion 140 for right-handed users.

FIG. 18 shows an alternative embodiment of mitt 132 in which strips 150, 152 are bonded to the back part of mitt body 134. Strips 150, 152 are preferably made of similar material, comprising any of the materials described above with reference to pad 24. However, if desired, the strips 150, 152 can be made of dissimilar materials. As with the other embodiments described herein, the strips 150, 152 are positioned to cover the backs of user's fingers, with the strip 150 positioned between the first and second joints of the user's fingers (similar to the position of strip 34 in FIG. 2) and with the lower strip 152 being positioned between the second and third joints of the user's fingers (similar to strip 36 in FIG. 2). The strips 150, 152 are preferably made of the same material, comprising any of the materials described above with reference to pad 24. However, if desired, the strips 150, 152 can be made of dissimilar materials and can have dissimilar thicknesses, if desired.

Figure 21:
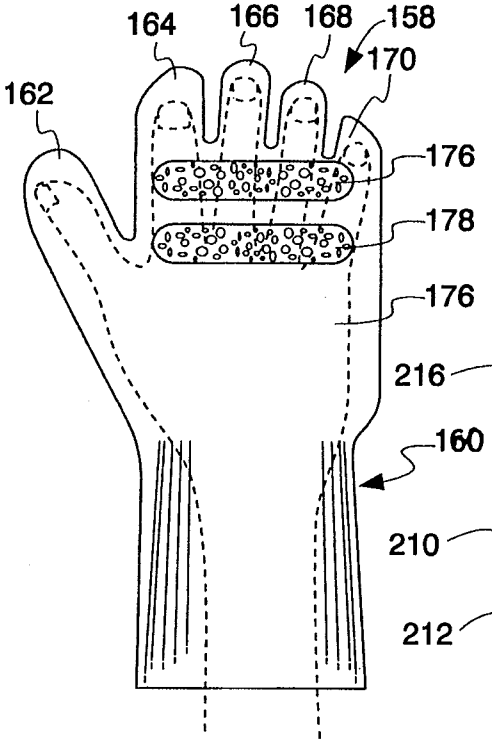
FIG. 21 is a top plan view similar to that of FIG. 20 but showing abrasive strips applied to the back of the mitt.

Turning now to FIGS. 19–21, a further embodiment of a mitt illustrating principles of the principal invention is generally indicated at 158. Mitt 158 includes a mitt body 160 having a thumb portion 162 and fingertip portions 164–170. Preferably, the fingertip portions 164–170 cover only the user's fingertips or a portion thereof, extending opposite a user's fingernails, up to approximately the first joint of the user's fingers. A cuff portion 172 preferably covers a portion of the user's wrist and forearm. The mitt body 160 is substantially identical to the mitt body 11 described above, except for the configuration of the fingertip portions.

FIG. 20 shows the back or top part 176 of mitt 158. As shown, the fingertip portions 164–170 generally cover a user's fingernails, although the fingertip portions could be further shortened, if desired. FIG. 21 shows an alternative embodiment of mitt 158 in which strips 176, 178 are bonded to the back part 176 of mitt body 160. The strips 176, 178 are preferably formed of materials similar to those described above with respect to pad 24. The strips 176, 178 are oriented in the manner similar to the strips 34, 36 described above with reference to FIG. 2.

Figure 24:
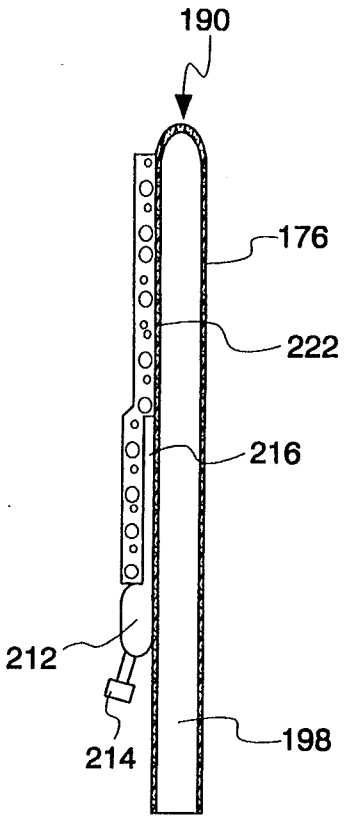
FIG. 24 is a cross-sectional view taken along the line 24—24 of FIG. 23.
Figure 23:
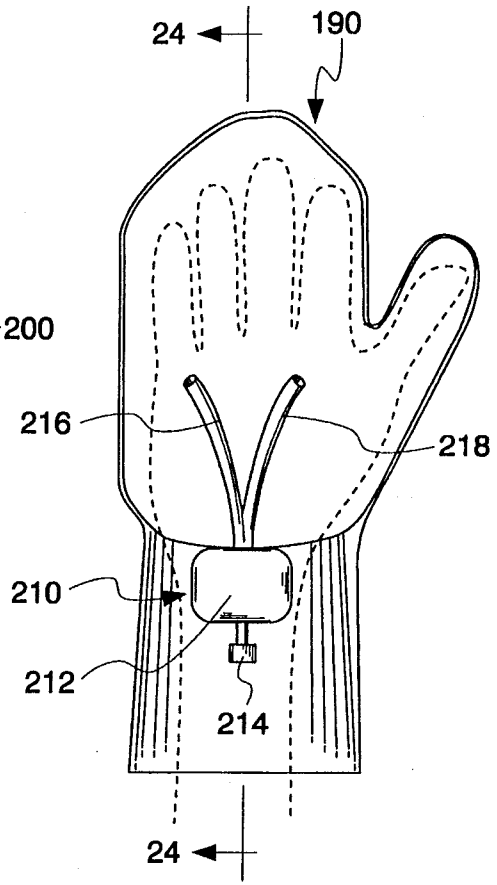
FIG. 23 is a view similar to that of FIG. 22 with the cleaning pad removed to show the fluid dispenser.
Figure 22:
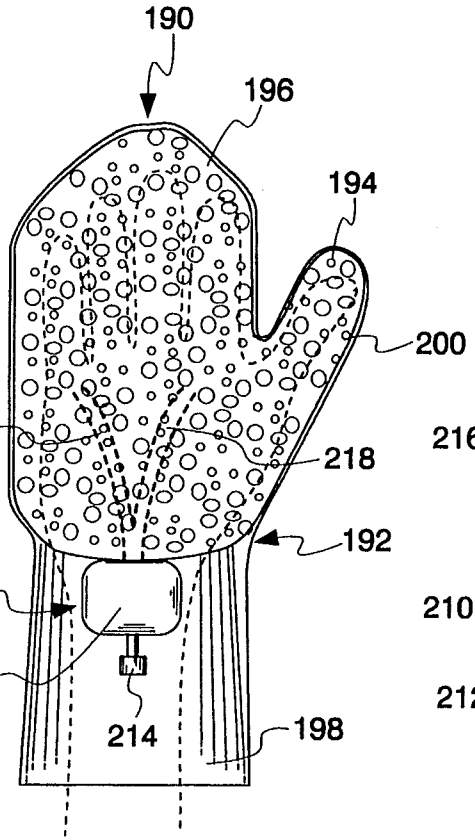
FIG. 22 is a bottom plan view of an alternative embodiment of the mitt illustrating principles of the present invention, having a fluid reservoir incorporated therein.

Turning now to FIGS. 22–24, a further embodiment of a mitt according to principles of the present invention is generally indicated at 190. Mitt 190 includes a mitt body 192 substantially similar to the mitt body 11 described above, and including a thumb portion 194 and a finger portion 196. A cuff portion 198 is also included. A pad 200 of cleaning material (similar to the materials described above with reference to pad 24) is bonded to the front part of mitt body 192 and preferably underlies a user's fingers, thumb and palm. A material dispenser is generally indicated at 210, preferably comprising a reservoir 212 defining a hollow interior volume with access being gained through a removable cap 214. Outlet tubes 216, 218 are connected to reservoir 212. Reservoir 212 is preferably made of flexible plastics material so that the contents of the reservoir are dispensed through the open ends of outlet tubes 216, 218 when pressure is applied to the reservoir by the user's wrist. Materials dispensed from the outlet tubes 216, 218 enter the pad 200. The materials dispensed could be either in powder or preferably in paste or liquid form. For example, soaps and water immiscible waxes could be used. As indicated in FIG. 24, outlet tubes 216, 218 are preferably located underneath pad 200, between pad 200 and the front part 222 of the mitt body. If less fluid material is required for a given application, it may be possible to impregnate the pads and strips of the various embodiments illustrated above with water soluble components of the material.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A cleaning device for protecting the hand and for providing cleaning media, comprising:

a mitt of latex material for receiving a user's hand and wrist;

the mitt comprising a thumb portion, a finger portion and a cuff portion having opposed front and back surfaces with the front surface covering at least some of the palm and adjacent inner finger surfaces of a user's hand and the back surface covering at least part of the back of the user's hand;

a pad cleaning media covering substantially all of the portion of the front surface of the mitt covering the user's palm, fingers and thumb; and a fluid dispenser comprising a reservoir of fluid carried on the mitt adjacent the pad and having outlet means for dispersing fluid into the pad of cleaning media said outlet means comprises tubes extending along the front surface between the pad of cleaning media and the front surface of the mitt.

2. The cleaning device of claim 1 wherein the fluid dispenser is carried by the mitt so as to be located adjacent the user's wrist.

* * * * *